US008915732B1

(12) United States Patent
Bebon et al.

(10) Patent No.: US 8,915,732 B1
(45) Date of Patent: Dec. 23, 2014

(54) VENTLESS FIREPLACE

(75) Inventors: Michael Bebon, New York, NY (US); Paul Dowd, Scarsdale, NY (US); Erol Searfoss, Brooklyn, NY (US); Philippe Putzeys, New York, NY (US)

(73) Assignee: Bebon Technologies, LLC, New York, NY (US)

( * ) Notice: Subject to any disclaimer, the term of this patent is extended or adjusted under 35 U.S.C. 154(b) by 642 days.

(21) Appl. No.: 13/279,286

(22) Filed: Oct. 23, 2011

Related U.S. Application Data

(60) Provisional application No. 61/406,146, filed on Oct. 24, 2010, provisional application No. 61/438,548, filed on Feb. 1, 2011.

(51) Int. Cl.
*F24B 1/18* (2006.01)

(52) U.S. Cl.
USPC ..... 431/152; 431/144; 431/146; 431/149; 126/43; 126/25 AA; 126/25 C; 126/500; 126/541

(58) Field of Classification Search
USPC ..... 126/25 AA, 25 C, 43, 541, 500
See application file for complete search history.

(56) References Cited

U.S. PATENT DOCUMENTS

| | | | | |
|---|---|---|---|---|
| 2,156,799 | A * | 5/1939 | Benedict | 160/97 |
| 2,590,418 | A * | 3/1952 | Kobler et al. | 126/261 |
| 2,598,997 | A * | 6/1952 | Hyman | 126/545 |
| 2,803,240 | A * | 8/1957 | Howell | 126/93 |
| 2,885,253 | A * | 5/1959 | Kesling | 312/236 |
| 2,985,165 | A * | 5/1961 | Peterson et al. | 126/541 |
| 3,805,762 | A * | 4/1974 | Nelson | 126/506 |
| 4,040,796 | A * | 8/1977 | Vincent et al. | 44/519 |
| 4,255,117 | A * | 3/1981 | Trotta | 431/34 |
| 4,515,146 | A * | 5/1985 | Wilkening | 126/545 |
| 4,557,687 | A * | 12/1985 | Schirneker | 431/291 |
| 4,692,168 | A * | 9/1987 | Dotson et al. | 44/265 |
| 4,838,781 | A * | 6/1989 | Fischer | 431/125 |
| 4,852,476 | A * | 8/1989 | Sanchez | 99/443 R |
| 4,899,722 | A * | 2/1990 | Horewitch | 126/39 H |
| 5,026,271 | A * | 6/1991 | Orlov et al. | 431/125 |
| 5,858,036 | A * | 1/1999 | Chandaria | 44/535 |
| 6,132,481 | A * | 10/2000 | Chandaria | 44/535 |
| 6,609,512 | B2 * | 8/2003 | Poe et al. | 126/25 A |
| 6,755,877 | B2 * | 6/2004 | Perlman | 44/534 |
| 6,919,884 | B2 * | 7/2005 | Mix et al. | 345/204 |
| D569,493 | S | 5/2008 | Weinberger | |
| 7,647,923 | B2 * | 1/2010 | Dahl | 126/25 A |
| 7,799,102 | B2 | 9/2010 | Weinberger | |
| 7,905,224 | B2 * | 3/2011 | Flather | 126/25 A |
| 8,434,470 | B2 * | 5/2013 | Jensen | 126/93 |
| 2002/0179080 | A1 * | 12/2002 | Poe et al. | 126/25 A |

(Continued)

*Primary Examiner* — Jorge Pereiro
(74) *Attorney, Agent, or Firm* — Gordon Kessler

(57) ABSTRACT

A ventless fireplace is provided, including a protective fireplace door, a wall positioned behind the protective fireplace door, a hearth surface positioned adjacent the wall, the protective fireplace door, wall and hearth surface defining a cavity the hearth surface further defining an opening therein, and a mechanical structure for housing one or more fuel cells positioned below the hearth surface, so that when operational, one or more flames emanating from the one or more fuel cells supported by the mechanical structure pass through the opening in the hearth surface. The protective door further includes a door frame, a door bezel hingedly attached to the door frame by one or more hinges, a door screen fixed within the door bezel, and a latch assembly fixed to the door frame to selectively engage the door bezel from the door frame.

11 Claims, 11 Drawing Sheets

(56) References Cited

U.S. PATENT DOCUMENTS

| | | | | |
|---|---|---|---|---|
| 2003/0005920 | A1* | 1/2003 | Poe et al. | 126/25 A |
| 2003/0087212 | A1* | 5/2003 | Perlman | 431/6 |
| 2003/0201957 | A1* | 10/2003 | Mix et al. | 345/87 |
| 2005/0150487 | A1 | 7/2005 | Weinberger | |
| 2005/0178379 | A1 | 8/2005 | Weinberger | |
| 2005/0227194 | A1 | 10/2005 | Weinberger | |
| 2005/0247302 | A1 | 11/2005 | Weinberger | |
| 2006/0110695 | A1 | 5/2006 | Weinberger | |
| 2006/0157049 | A1 | 7/2006 | Weinberger | |
| 2006/0219233 | A1* | 10/2006 | Sorenson et al. | 126/9 R |
| 2007/0272232 | A1 | 11/2007 | Weinberger | |
| 2008/0197138 | A1* | 8/2008 | Flather | 220/592.16 |
| 2009/0038606 | A1 | 2/2009 | Weinberger | |
| 2009/0050034 | A1* | 2/2009 | Dabrowski | 110/186 |
| 2009/0241936 | A1* | 10/2009 | Husted et al. | 126/512 |
| 2010/0192933 | A1* | 8/2010 | Andersson | 126/43 |
| 2010/0242947 | A1 | 9/2010 | Weinberger | |
| 2011/0048402 | A1* | 3/2011 | Houle | 126/512 |
| 2011/0186039 | A1* | 8/2011 | Chomiuk et al. | 126/512 |
| 2012/0037141 | A1* | 2/2012 | Jensen | 126/93 |

* cited by examiner

VENTLESS FIREPLACE

CROSS REFERENCE TO RELATED APPLICATIONS

This application claims the benefit of U.S. Provisional Patent Application Ser. No. 61/406,146 filed Oct. 24, 2010 to Bebon et al, titled Ventless Fireplace, and claims the benefit of U.S. Provisional Patent Application Ser. No. 61/438,548 filed Feb. 1, 2011 to Bebon et al., titled Ventless Fireplace, the entire contents of each of these applications being incorporated herein by reference.

FIELD OF THE INVENTION

This invention relates generally to a fireplace system preferably utilizing a modular alcohol gel fuel cartridge, and in particular the invention relates to such a fireplace system utilizing a modular alcohol gel fuel cartridge including enhanced safety and convenience features, including assisted fuel loading and removal, remote lighting, extinguishing, and other operation, a fully automated burn unit and integrated enclosure, and one or more interlocking mechanisms.

BACKGROUND OF THE INVENTION

Traditionally fireplaces have burned flammable material, such as wood or the like. However, there are many locations in which a flue, vent or other exhaust system is impractical. Therefore, various ventless fireplace options have surfaced. These options rely on natural gas, gel or liquid alcohol mixtures, or other materials that do not result in dirty exhaust gases or particles. Ventless fireplaces are desirable in that they allow for the beauty and ambiance associated with a traditional fireplace to be provided in a location without available venting, heat protection, or other elements required to be employed in accordance with such a traditional fireplace. The gel alcohol fuel burns cleanly, therefore presenting no pollutants common to wood burning fireplaces. As the heat generated from such a ventless fireplace is substantially less than that from a wood burning fireplace, substantially less structure is required for fire and heat protection. Finally, such a ventless fireplace is able to be started and stopped quite easily, igniting the fuel to start, and snuffing out the fuel to turn the fireplace off.

While such ventless fireplaces are convenient in many ways, many features associated with them are cumbersome to a user. In particular, existing products in this market typically employ either a liquid fuel that is poured into the fireplace, or a simple metal can of fuel with a plastic cover.

In the case of using a can filled with fuel, and including a plastic cover, the user is typically required to remove the plastic cover, insert the can into the fireplace, and light the can of gel with a long match or gas lighter. Alternatively, a traditional round sterno chafing dish type material may be employed, but gives an unrealistic flame. If the user wishes to extinguish the fireplace flame before the fuel in the can has run out, the flame may be required to be manually snuffed by covering the opening in the fuel can with a panel of material. Because there is a hot flame emanating from this opening, users may be uncomfortable with this snuffing procedure. Further, they require manual removal of fuel cell seals, thus risking leaking of gel alcohol fuel, manual ignition of the fuel, and manual extinguishment if the fuel is not exhausted, raising safety and convenience concerns, Use of the liquid fuel requires that the user access a fuel refilling port included with the fireplace, and manually pour the fuel into the fireplace into an available vat or the like. These liquid fueled systems are also typically required to be manually lit and snuffed in a manner similar to that of the fuel can fireplaces. This process may be messy for the user, and may be one which the user is uncomfortable performing if the fireplace is in use or has recently been in use, perhaps resulting in hot fireplace parts. Indeed, the Consumer product safety has issued a recall of a number of products employing such pourable fuel. The recall states "Due to the serious risks of flash fire and burns when consumers add pourable gel to an already burning fire pot, consumers should immediately stop using the pourable gel fuel. The pourable gel fuel can ignite unexpectedly and splatter onto people and objects nearby when it is poured into a firepot that is still burning . . . . All pourable gel fuel, regardless of manufacturer, poses flash fire hazards."

While the gel alcohol ventless fireplace has been gaining in popularity, as described above, many of the systems currently available for handling fuel are quire messy and inconvenient. Therefore, it would be desirable to provide an apparatus and system that allow for easier and safer use by a user, and that overcomes other drawbacks of the prior art.

SUMMARY OF THE INVENTION

In accordance with various embodiments of the invention, a fireplace unit is preferably adapted to be installed into the hearth of a fireplace, though it may also be provided as a stand-alone unit fireplace or stove. The various embodiments of the present invention seek to provide an improved alcohol gel fireplace system with enhanced safety and convenience features. In accordance with these various embodiments, handling of a fuel cartridge is limited and in some embodiments is designed to encapsulate the fuel at all times except when the cartridge is actually installed in the fireplace and is burning. Such a system may prevent access to the fuel in the cartridge and as such guard against inadvertent spilling of the fuel by the user, and further prevent such a fuel cartridge from being ignited outside the fireplace, or from being removed from the fireplace while still ignited. Additionally, various embodiment of the inventive fireplace system may automate many of the tasks normally performed by the user, such as opening the cartridge, lighting, and snuffing the flame, thereby further reducing the operating burden on the user while further enhancing safety and convenience.

Therefore, in accordance with one or more embodiments of the invention, a fully automated gel alcohol fireplace burn mechanism is provided that allows for the simple, safe and clean insertion of one or more fuel cells into a fireplace burn unit. Such automation also preferably allows for automated ignition of the fuel cells and automated extinguishment of the flame if desired. Once the flame is extinguished, mechanisms constructed in accordance with embodiments of the present invention preferably snuff and seal the fuel cells to retain any remaining alcohol gel fuel, prevent any unpleasant odor from escaping into the ambient airspace, and retain the fuel cells for a time allowing for the temperature thereof to reduce to a level safe for a user to touch and remove them.

Such automation therefore provides an improved ventless fireplace allowing for easy, clean and safe use by a user.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangement of parts that are adapted to affect such steps, all as exemplified in the following detailed disclosure, and the scope of the invention will be indicated in the claims.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The invention will now be described making reference to the following drawings in which like reference numbers denote like structure or steps. Four main fireplace elements may be provided shown, including a door, a decorative fireplace structure, a mechanical module, and a fuel cartridge. Each of these elements will now be discussed in greater detail.

Figure 1:
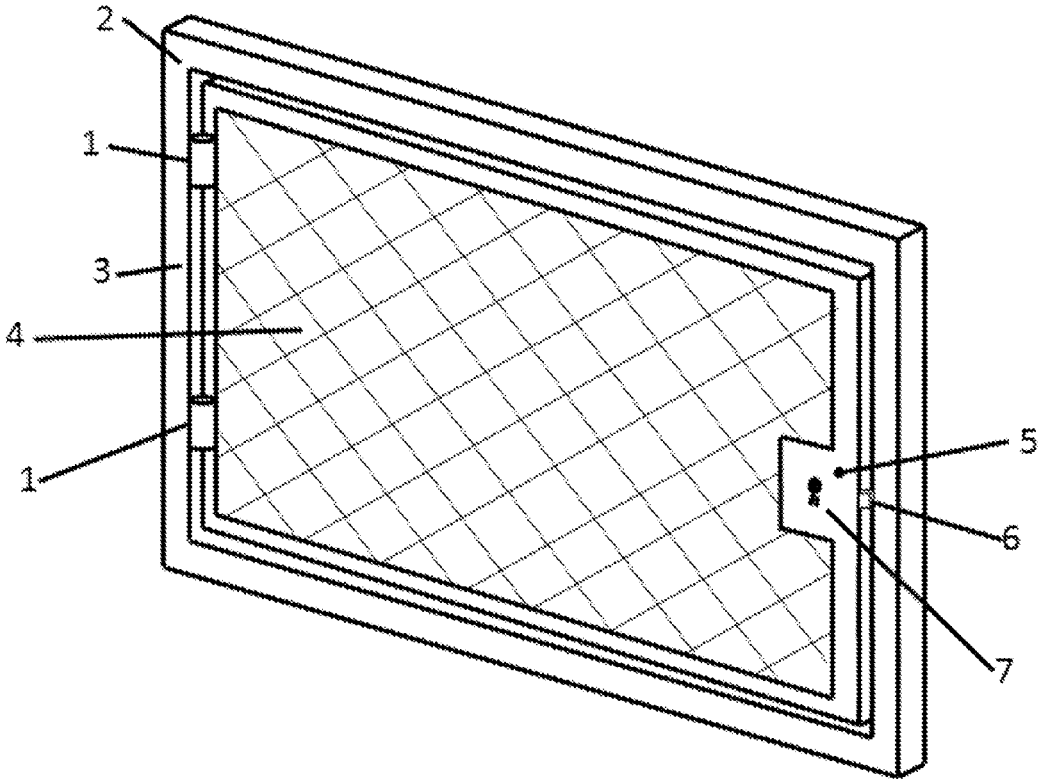
FIG. 1 depicts a door mechanism in accordance with an embodiment of the present invention.

Referring first to FIG. 1, an overall depiction of an inventive fireplace system presented in accordance with an embodiment of the invention is provided. As is shown in FIG. 1, a protective fireplace door may be provided which preferably consists of a door frame 2, a door bezel 3 hingedly attached to door frame 2 by one or more hinges. A door screen 4 is fixed within bezel 3. A latch assembly preferably includes a solenoid lock 6 for selectively locking and unlocking door bezel 3 from door frame 2, and also includes a keyhole 7 to allow for a manual override of the solenoid lock. The solenoid lock may allow control electronics to regulate access to the interior of the fireplace. An infrared (IR) sensor may further be provided to receive one or more IR signals from one or more IR signal generator sources, such as an IR remote control or the like. The IR sensor may receive signals from a remote control and passes any such received signals to control electronics associated with the ventless fireplace. The door is preferably perforated to provide air circulation to the burning fuel cartridge. The latch assembly may further incorporate a mechanical or magnetic detent latch. The detent latch may be employed to keep the door closed when it is unlocked As noted above, a keyhole may be provided to allow for manual override of the solenoid lock.

Figure 2:
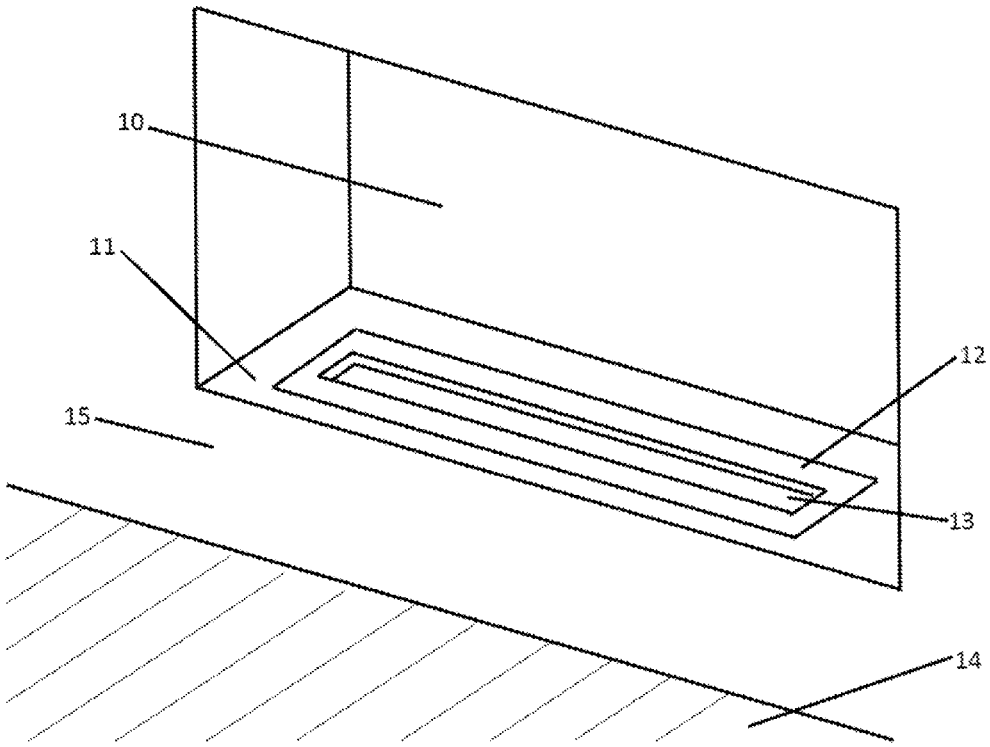
FIG. 2 depicts a fireplace recess in accordance with an embodiment of the present invention.

A decorative fireplace structure may also be provided, which incorporates the shape, visual appearance, and visible structure of the fireplace. Of course, if the fireplace structure is provided as a stand-alone unit, one or more of the elements related to such decorative fireplace may be omitted or modified. As is shown in FIG. 2, this structure preferably consists of a cavity 10 behind the door (where the flame will be visible), and further defined by a wall 15 and floor 14 supporting a hearth surface 11. Hearth surface 11 further defines an opening 13 having a hearth cover 12 inserted therein. Opening 13 provides access to a cavity 20 (see FIG. 3) defined by wall 15 and hearth surface 11 in which the mechanical structure associated with the fireplace will be positioned, and further allows for the insertion and removal of fuel cartridges, and finally allows for emergence of flames from the fuel cartridges. Cavity 20 is preferably provided with access to AC power. Hearth cover 12 is preferably constructed of a fireproof material. Thus, the outer shape of hearth cover 12 is preferably big enough to cover opening 13 in hearth surface 11.

Figure 4:
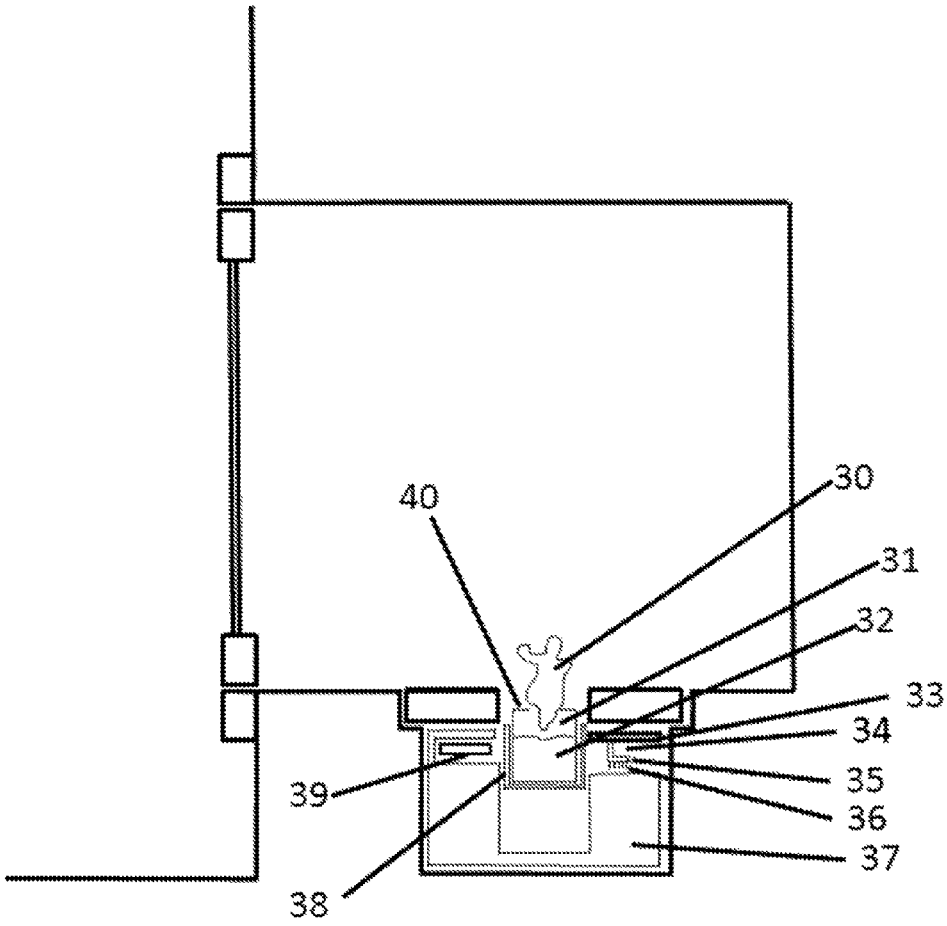
FIG. 4 depicts a cross sectional view of various components of the fireplace in accordance with an embodiment of the present invention in operation.

Referring next to FIG. 4, a mechanical module is preferably provided as a modular automated device which preferably loads, retains, lights, burns, snuffs, and ejects the fuel cartridges from the fireplace unit in an automated or manual manner in accordance with one or more instructions or actions initiated by a user. This unit is preferably self-contained and need only to be plugged into AC power (or otherwise be provided with an adequate power source). A fuel cartridge 40, holding fuel 32 therein, is positioned within the mechanical module, and has a flame 30 emanating therefrom and passing through a burn chamber 31 further defined by fuel cartridge 40. A selectively positionable elevator 38 preferably supports fuel cartridge 40, and allows for the selective positioning thereof. A mechanical unit support structure 37 further supports an igniter 39, for igniting fuel 32 contained within fuel cartridge 40, and a lid 33, further preferably comprising a tucking gap 34, a cutting plate 35, and cutting blades 36. The mechanical module may also be connected to a door lock cable, thus retarding the operation of the fireplace unit door when the fireplace is in use. This mechanical unit is preferably positioned so as to be housed within the hearth cavity 20 and covered by the hearth surface 11 and cover 12. As noted above, cartridges are preferably loaded by passing them through the opening in hearth cover 12 and into the mechanical unit. The mechanical unit preferably further may include a control module for controlling the various functioning of the various components of the fireplace, in accordance with an embodiment of the invention.

Mechanical unit support structure 37 provides form to the unit and is preferably made of sheet stainless steel or other appropriate material. Elevator 38 preferably forms a holding chamber structure for holding any number of desired and appropriate fuel cartridges, each of which may be a rectangular shaped structure with four walls, a bottom, and an open top. This chamber is preferably sized to comfortably fit any number of fuel cartridges that the unit is designed to hold.

Figure 5:
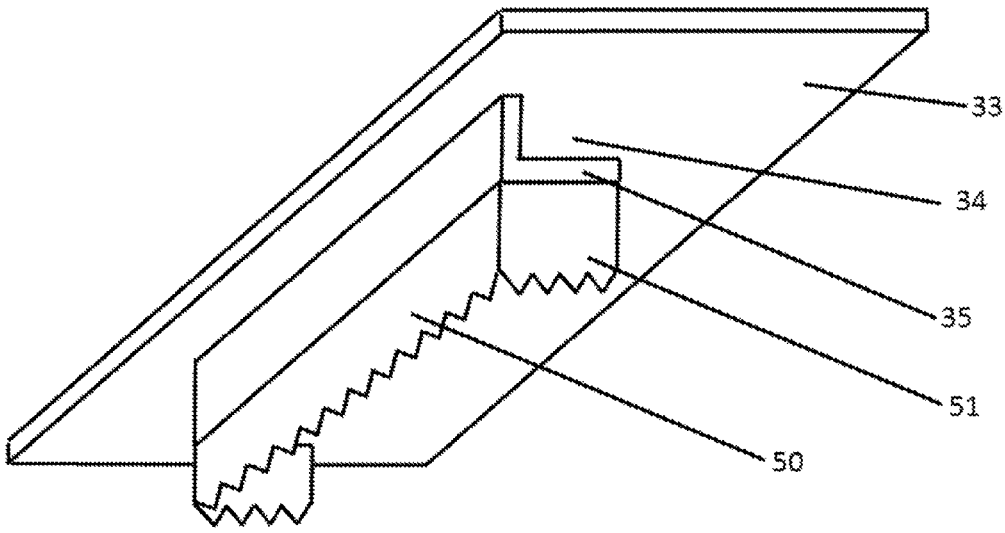
FIG. 5 depicts a top for use in accordance with an embodiment of the present invention.

FIG. 5 depicts a further view of movable lid 33 is provided which is adapted to cover the opening in the top of the holding chamber formed by elevator 38. The lid is preferably made of stainless steel sheet or other appropriate material. This lid preferably slides parallel to the floor in directions perpendicular to the long side of the fuel chamber. Alternatively, lid 33 may be adapted to selectively rotate in an arc about an axis roughly in the location of the bottom long edge of the fuel holding chamber. As is noted above, lid 33 is preferably formed with tucking gap 34, cutting blade support plate 35, and cutting blades 36, further comprising lateral cutting blade 51 and longitudinal cutting blade 50. The lid preferably has three positions, open, closed, and "tuck" which is a position whereby it the lid is adapted to "tuck" the foil of the fuel cartridge away from its unused, sealed position into its open, ready for use position. This tuck position may be provided somewhere between the open and closed position, but preferably closer to the closed position. Of course, such "tuck" position may be provided at any location convenient for opening a foil or other covering on a fuel cartridge.

Figure 6:
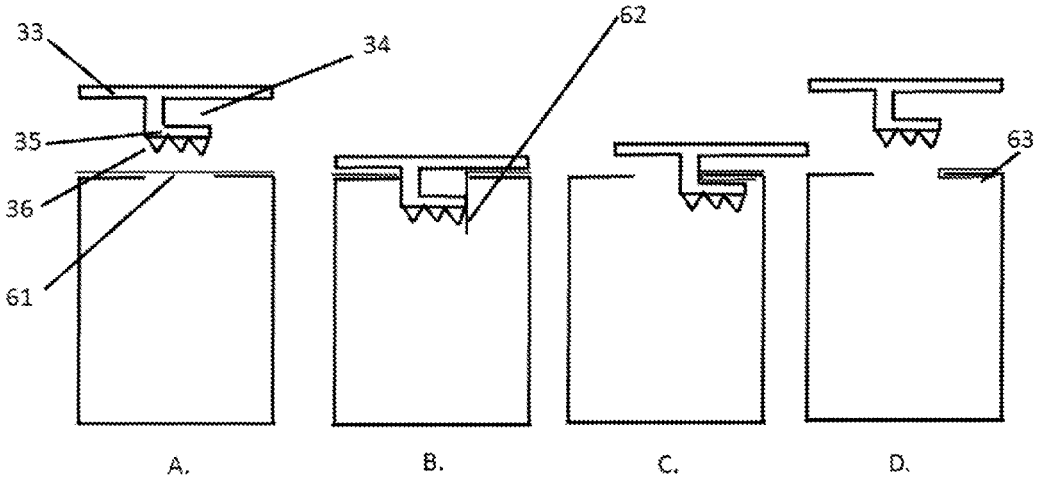
FIGS. 6*a-d* depict various positioning of a fuel canister in accordance with various elements of the fireplace in accordance with an embodiment of the invention.

FIGS. 6*a*-6*d* depict these various positions of lid 33 providing the sequence of steps in the cutting and tucking cycle of puncturing the fuel cartridge, in accordance with an embodiment of the invention. As is shown in FIG. 6*a*, lid 33, and its various cutting and tucking components as depicted in FIG. 5, is preferably positioned above fuel cartridge 40*b*. Thereafter, in FIG. 6*b*, the fuel cartridge 40 is raised to meet cutting blades 50, 51 of lid 33 to cut a foil protector seal 61 positioned atop fuel cartridge 40, as shown at 62, thereby forcing the foil into the cartridge, making a roughly 90 degree bend in the foil seal. Next, lateral movement of lid 33 is provided to tuck the foil seal into a shape 63, thus providing a greater folding angle in the foil. Finally, lid 33 is removed, revealing an unsealed and opened fuel cartridge.

In the depicted embodiment of the invention, as the lid moves from the closed position to the open position, in this open position, lid 33 allows the free passing of fuel cartridges 40 in and out of the fuel chamber formed by elevator 38. In the closed position, lid 33 preferably seals the fuel chamber formed by elevator 38, and preferably fuel cartridge 40 in such a way to prevent, or at least slow, the evaporation of unspent fuel.

Elevator platform 38 may be adapted to move, and therefore preferably forms a movable support surface for fuel cartridges 40. Moving elevator 38 up and down has the effect of respectively raising and lowering the fuel cartridges. The platform may further be provided with a latching mechanism which grips the fuel cartridges and prevents them from being released from the platform unless it is in its upper-most position. The elevator platform may be controlled manually by a user, by the use of a remote control or other remote indicator, or in an automated sequence or other manner.

A control module may be provided to control the various functionality provided in accordance with the inventive fireplace system. A fireplace receiver assembly (such as IR receiver 7) may be controlled by an IR or RC remote which may allow the user to access one or more of the fireplace system functions, including allowing the user to turn the flame on, turn the flame off, eject the cartridge, or performing any other available function by selecting the appropriate button. A control panel on the face of the fireplace, or other input device or mechanism may also provide these functions. Alternatively, a smartphone, netbook, laptop, or other computer or mobile device such as an iPad may provide the control functions wirelessly or through a wired network. The control module, may further be programmable, and may also be adapted to control the ignition, snuffing of the flame, and ejection of the fuel cartridge, and may employ various logic functions to further enhance safety and convenience. As mentioned above, various sensors such as switches and temperature sensors can detect the status of various parts of the system, such as the presence of the fuel cartridge, the temperature at various spots via one or more temperature sensors, the state of the door screen and its lock, etc. Using this information, the control logic may choose to disallow access to a burning or hot fuel cartridge, snuff out the flame if it detects the screen being opened for example, or provide any further desirable control functionality Optionally, there may be a "fuel gauge" function which may allow the user to interrogate the unit to discover whether the fuel is nearing empty. This may be provided by either by tracking the cumulative burn time on the remote, or on the base unit, and providing feedback in the form of a numerical or graphical display. Other measures, such a fuel cartridge weight or the like may be provided to determine such fuel remaining status. The display may alternatively comprise a simple light which may flash in a coded way to indicate how much time is left. For example, the duration, speed, or number of flashes may be used to communicate that information. Since the IR remote only transmits, if the fuel level function was to be incorporated into the base unit, there may be an added button on the remote in order to prompt the fireplace unit to display the current fuel level. Alternatively, a two way remote, or any of the devices noted above, may be provided with a fuel remaining readout.

As noted above, the preferred embodiment preferably incorporates a fuel cartridge that consists of a non-flammable can (preferably aluminum, but steel or other metals or non flammable materials could be used) containing an alcohol gel fuel, optionally with additives for scent, flame color, and combustion sounds ("crackle and pop"). The preferred fuel cartridge may be rectangular in shape and approximately three inches high, two inches deep, and six inches wide, but ultimately is shaped in accordance with the shape of elevator 38. The fuel cartridge preferably has an oval or rectangular opening in the top surface, approximately ¼" to ¾' smaller than the plan view size of the cartridge. This opening acts as the "burn zone" where the fuel vapors mix with oxygen and burn, creating the flame. The top opening is sealed in two ways. First, a reusable plastic cover ensures a mechanical seal for storage and shipping. Second, a foil or sheet material is sealed to the surface of the can and completely covers the opening, providing an air tight seal. The sheet seal reduces/prevents leakage, evaporation, or degradation of the gel fuel.

Fireplace System Functions—The following describes the status of one or more components of the system in accordance with the various states the system, and will be now be described in accordance with a preferred embodiment of the invention.

Loading the Fuel Cartridge

With the door of the fireplace closed, an "eject" sequence is preferably initiated, in one embodiment through activation of a button on a remote, which opens the cover of the mechanical module and raises the fuel cartridge platform to its highest position. Any cartridges in the unit will therefore be raised to a height where they are above the fireplace structure and can be grasped by the top edges of the fuel cartridge. Before inserting a new cartridge, the user preferably removes its protective plastic cover. If a spent cartridge is being removed from the fireplace, the cover can be used to cap the exhausted fuel cartridge to retain any residue for neater handling and disposal. The new fuel cartridge can then be inserted into the open top of the mechanical unit. One or more cartridges may be inserted in a linear arrangement, end to end. Once the new fuel cartridges are inserted into the fireplace, the fuel remains sealed in the fuel cartridges and will be preserved ready to light for a very long time. Closing the door of the fireplace initiates a "load" cycle wherein the mechanical unit preferably lowers the fuel platform and close a cover over the fuel cartridges.

Unsealing of the Cartridge—The user may light the fireplace by initiating an "on" sequence, preferably through activation of a button on the remote control, which initiates a lighting cycle in the mechanical unit. If the cartridge is newly inserted, it is first punctured by the mechanical fireplace (as described above) unit before ignition is attempted. In the preferred embodiment, the puncturing device consists of a set of serrated teeth on the underside of the moving lid. The positioning of the teeth correspond to three sides of the opening in the fuel cartridge. The long side corresponding to the back of the unit does not have a cutting blade. These teeth, or cutting blades, may be mounted on a rectangular or oval shaped overhung "cutting plate" which is mounted to the underside of the lid and is sized to fit inside the top opening of the cartridge. This plate is connected to the underside of the lid only along its front edge, and there is a gap between the top of the cutting plate and the underside of the lid. The state of the unit prior to puncturing is that the cartridge is in the lowest position and the lid is closed. To puncture the foil seal, the unit first raises the elevator up to "puncture height," a height such that the top of the cartridge is close to the underside of the lid, thereby forcing the cutting blades on the underside of the lid through the foil seal on the cartridge, cutting three sides of the opening. The side of the cutting plate without a cutting blade, being a bit higher than the tips of the blades, but lower than the underside of the lid, encounters the foil after the cutting blades have done their work, and forces the resulting flap of foil down into the cartridge. At this point the entire thickness of the cutting plate is inside the cartridge. The next step is to retract the lid slightly in order to force the rear edge of the cutting plate underneath the rear edge of the cartridge opening. This has the effect of "tucking" the foil flap under the top of the cartridge and getting it out of the way of the burn zone so that proper combustion of the fuel is not compromised. Next, the lid is returned from the tuck position back to the closed position, then the elevator is lowered to the lowest position.

Ignition of the Fuel—When the user decides to light the cartridge, an igniter either in a permanent location or attached to a movable arm (either linear or rotary movement) that is selectively positionable may be positioned adjacent the opening of the fuel cartridge, will ignite the fuel in the cartridge. The igniter may be in the form of a sparking member or an electric heating element. In a preferred embodiment a resistance heater-based igniter such as is used to ignite a residential gas dryer or gas oven is used. Such an igniter may consist of a heating element mounted to an insulating base with a sheet metal shroud. The igniter may be powered by AC house current. The igniter may be located in the center of each fuel cartridge for ignition, or it may be located directly between two fuel cartridges in order to light two cartridges with each igniter. The initial state of the unit is that the cartridge is at the lowest position, the cartridge foil seal has been punctured, and the lid is closed. To ignite the fuel, the lid is moved to the open position, the igniter is extended over the opening in the cartridge, the igniter is energized for a predetermined amount of time, the igniter is withdrawn, and the elevator raises the cartridge to a "burn height."

Burning and Extinguishing the Fuel—The burn height of the cartridge is lower than the eject height in order to not have the cartridge exposed to view, but it is higher than the height it was at when ignited. This is because the igniter needs to be lower than the underside of the fireplace hearth cover, but higher than the top of the cartridge. When burning, it is better for the cartridge to be as high as possible without being visible, in order to maximize the visual display of flames and minimized the amount of heating of the fireplace structure or mechanical unit that results from the flames. When burning, the fuel cartridge acts as the burner—the fuel in the cartridge itself is burning and the flames arise from the opening in the top of the cartridge. To extinguish the flame, the elevator is lowered and the lid is moved to the closed position. Then the elevator is moved up to the puncture height, which seals the cartridge against the underside of the lid, preventing the cartridge from drying out.

In a first alternative embodiment of the invention, the cartridge may be provided with a metal or other moveable door instead of the foil seal that maintains a reasonably good seal with the can. The metal door may take the form of a sliding plate which moves outside the envelope of the fuel cartridge, and in that way physically locks the fuel cartridge under the top surface of the receiver housing. An internal catch is provided to prevent the door from opening. The catch in the fuel cartridge acts like a lock in the sense that it cannot be "unlocked" by hand. It requires a "key." In this case, the key is part of the fireplace receiver mechanism. One way to achieve this is to have two or more small holes in the cartridge which thin wires can be inserted to release the catch. These wires would be part of the fireplace receiver mechanism and would only release the catch by simultaneous insertion. Another possibility is for the wires to instead be thin spikes, and these spikes could actually penetrate the side of the fuel cartridge, obviating the need for holes. If the fuel cartridge were to be re-usable, the locations where the spikes penetrate could be foil patches which could be replaced during refurbishment of the cartridges.

Another embodiment of the invention may include a reusable cartridge that is permanently housed within the unit. The cartridge may be refilled via a disposable gel fuel pack. The gel pack and fireplace feature a sealing port that allows convenient and safe refilling and protects against spills. The gel pack can be plugged into the fireplace, emptied (filling the cartridge), and discarded.

In a preferred embodiment of the invention as described above, the fuel cartridge is rectangular and preferably 6" in length for ease of manufacturing and optimum packing, however the cartridge could take other forms, such as oval, pyramidal, cylindrical, etc. The cartridges could be made in various lengths, such as 12", 18", 24" and 30" to be used singly or in combination to form various length fireplaces.

Locking Receiver Mechanism—In one alternative configuration of an embodiment of the invention, the cartridge and the fireplace work together as a system to achieve the goals of improved safety and convenience. The sealed and locked fuel cartridge may be loaded into the fireplace by pushing it down into a spring-loaded receiver opening that is sized to fit the cartridge. Upon fully inserting the cartridge against the force of the spring, it may be latched in place by the fireplace and not removable by the user. The foil strip may be removed by the user to prepare the cartridge for use. At this point, only the top surface of the fuel cartridge is preferably exposed, the rest of it is embedded in the fireplace. The fireplace may include internal mechanisms to automate the process of lighting the cartridge, putting the flame out, and ejecting the cartridge from the fireplace for replacement, as noted above.

In order to light the cartridge, the fireplace lighting mechanism may first engage the locking feature of the cartridge with its matching key system in order to unlock the locked mechanical door in the fuel cartridge. Once the key system frees the mechanical door, the mechanical door may be opened by the fireplace mechanism and an ignition device in the fireplace would be activated, lighting the fuel cartridge. In addition to the fuel cartridge being latched in place (which happened upon initial insertion), the act of opening the door would provide a secondary mechanical means to prevent the cartridge from being removed from the fireplace. In other words, an open cartridge cannot be removed from the fireplace.

In order to put out the flame, the fireplace mechanism may simply close the mechanical door on the fuel cartridge by reversing the step taken to open it. The fuel cartridge may remain locked in the fireplace and the door of the fuel cartridge would revert to its normal closed and locked state.

To remove the cartridge from the fireplace, the user may activate an "eject" function which will release the latch which holds the cartridge in place, and preferably the cartridge will rise upwards out of the receiver opening, allowing it to be grasped by the user.

Automation—The steps outlined above may all be achieved by mechanical means, for example with buttons, levers, scissor mechanisms, gear trains, cables, chains, cams, or other mechanical devices. In addition, the insertion of the cartridge may set a spring which could be used to energize various functions. The ignition could be performed mechanically with a piezo-electric device, flint, or other sparking means. However, in a preferred embodiment of the invention, the fireplace may utilize electric power, either through batteries, plug in, or hard wired configurations. In this case, various electro-mechanical devices can be used to operate the mechanical functions of the fireplace.

The fireplace is preferably the structure containing the receiver mechanism and including the aesthetic elements such as the hearth, mantle, screen, etc. In addition to the safety features inherent in the fuel cartridge and the receiver unit, the fireplace structure would include the use of fireproof/fire resistant materials such as stone, marble, and "dragonboard" produced by Dragnboard USA, to isolate the hot parts of the device from heat sensitive parts such as the electronics. Thus, such Dragonboard or other appropriate material may be used in various locations, including inside the hearth, or on the mechanical portion of the fireplace to improve the safety aspect of such a fireplace, and thus insuring that heat and flame is properly maintained within the fireplace. Another feature of the fireplace is a screen that may be lockable by the user, and the screen would include a sensor (limit switch, contact switch, proximity sensor, magnetic leaf switch, etc.) in order to detect whether the door was closed and whether the door was locked. This information is used by the control module to prevent access to the fireplace when it is burning, or when it is hot, perhaps by use of a timer and/or a temperature sensor.

Figure 7:
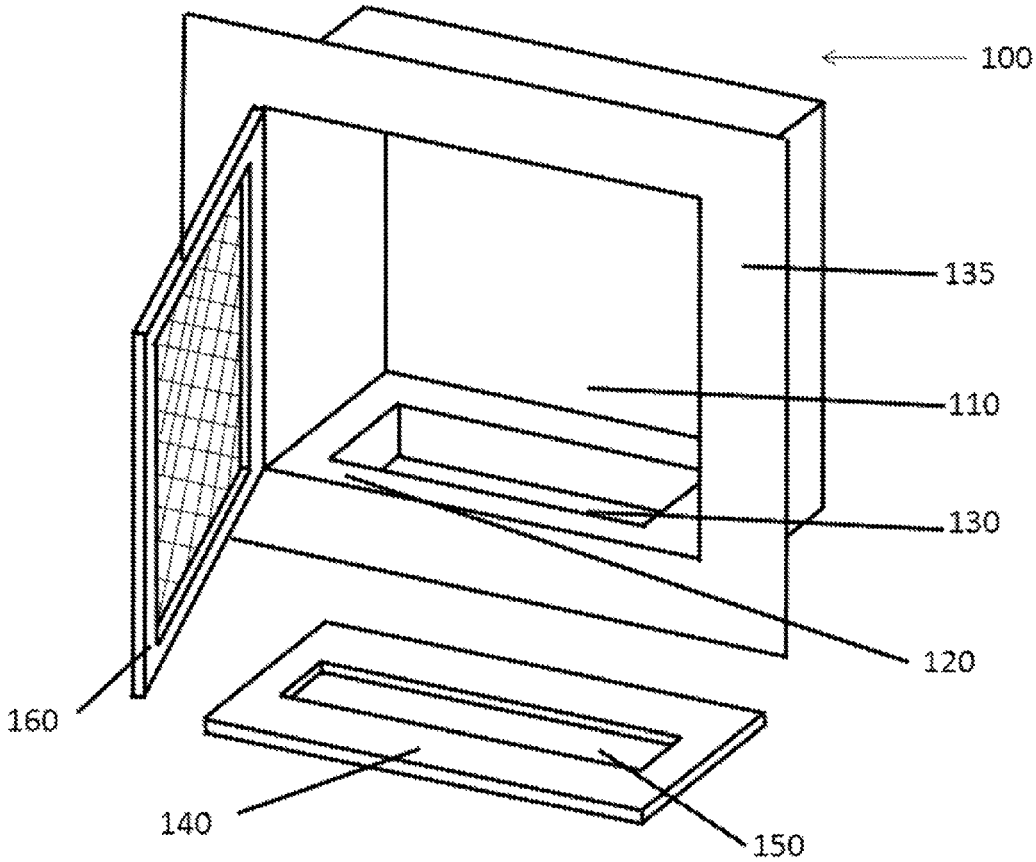
FIG. 7 is perspective view of a fireplace cabinet constructed in accordance with an embodiment of the invention.

An alternative embodiment of the invention will now be described. Referring first to FIG. 7, an unvented alcohol-burning fireplace enclosure 100 is shown, comprising a structural insulating box 100, and a door 160 preferably fixed thereto with side opening hinges. Insulating box 100 may be manufactured as an integral assembly of sheet metal panels with a double-wall construction providing space for fiberglass insulation, or may include other appropriate construction material. The double wall structure is preferably uninterrupted on the sides, back, and top of the box, but may be formed of individual pieces attached to form the final structure. A flange 130 may be provided, defining an opening therein which may be covered by door 160. A bottom surface 120 of structure 110 preferably defines a space 130 therein for acceptance of a burn unit, as described below. Provision is made to pass wiring through one or both sides of space 130 to power the burn module. Interior of surfaces of structure 130 (other than preferably the bottom) may be provided with means to affix sheets of stone or other desired material for decorative purposes.

A removable cover panel 140 is provided dimensioned to fit and be retained within space 130, and substantially coplanar with bottom surface 120. Cover panel 140 further defines a space 150 therein for eventually allowing flames from the burn unit (to be described below) to pass therethrough. Cover panel 140 may further be provided with one or more perimeter stone panels affixed in place. Removable cover panel 140 may be dimensioned to be slightly larger than opening 130 in bottom panel 120. Rectangular opening 150 preferably corresponds to the space required to load one or more fuel cartridges into the burn module, and for the flame to emerge. Alternatively, removable cover panel 140 may be removed to insert the one or more fuel cells.

Flange 135 defines the opening covered by door 160. Door 160 is preferably formed by at least part of a screen or grating to allow airflow and heat flow there through. The purpose of the door screen is to prevent access to the burn unit while in use, including when any parts are in motion, or when fuel is burning, and to prevent flammable objects in the room from coming in contact with the flame. The door screen is preferably attached to the box with vertically-oriented hinge pins, allowing the door to swing like a regular door. The front edge of flange 135 surrounding the door may be recessed ¾" or other appropriate amount to allow for the flush mounting of decorative stone material. The door itself is preferably comprised of a frame, hinge details, latch details, a switch, and a mesh covering across the surface of the door. In the preferred embodiment, the hinge is a simple pin design, and the latch is a spring-loaded latch much like the latch found in a typical residential door. In a preferred embodiment however, there is no knob to retract the latch. Instead the latch is retracted with a solenoid controlled by a controller in the burn module. A manual override for opening the door screen may also comprise slipping a thin object, such as a credit card, into the gap between the door and the adjacent box in the area of the latch, thereby forcing the latch out of engagement with the striker on the box. In addition, the door may preferably be equipped with a sensor switch to provide feedback to the burn module controller as to the status of the door. The functions and logic relating to the door switch and solenoid will be described in the section below covering the burn module.

In accordance with an alternative embodiment of the invention, a fireplace system may be provided as a double-sided system. This configuration may look very much like the system depicted in FIG. 1, however all or a portion of wall 110 may instead be removed, thus providing access to space 130 and cover panel 140 via a second opening, thus also providing additional access to the beauty of the fireplace from an additional direction. This additional opening may be provided with a second flange 135 and door 160 described above in accordance with the first opening. This second door may be mounted to the second opening in a manner similar to that as described above, and may preferably include one or more of the additional features described above regarding the description of door 160, such as solenoid latch, sensing switch, etc.

Referring next to FIGS. 8-11, a burn module 200 preferably comprises an electro-mechanical device that is comprised of a steel box 210 that encloses a self-contained mechanical unit 300 which loads, ignites, snuffs, and ejects the fuel cartridges as will be described below. Mechanical unit 300 is preferably controlled by a microchip which embodies the functional parameters that control the system, as well as handling any desired communications with any various input-output devices, such as an Ethernet interface, wireless remote, wireless network devices, various sensors, and the like.

In addition to being programmed to operate burn unit 300, the microchip may be provided with additional functions, such as interacting with one or more remote controls or other mobile devices. If provided with speakers, one or more sounds may be emitted therefrom, including music, white noise, nature sounds, or fire crackling or other burning sounds, or the like. In such a manner, a fuel that burns cleanly may be employed, and supplemented with sounds to give a more realistic overall experience.

Burn module 300 is adapted to accept one or more fuel cells 220 into a carrier box or elevator 310. Elevator 310 is lifted up and down from an elevator cavity 315 in burn module 300 by an elevator lifter arm 320. Cavity 315 is preferably large enough that when elevator 310 is down, the entire elevator 310 with one or more fuel cartridges 220, plus lifter arm itself 320, preferably fit within the confines of cavity 315. Cavity 315 is preferably sealed, except for being open at the top, thus defining a top opening 317. A pivot rod 330 for lifter arm 320 penetrates the wall at each end of cavity 315, pivot rod 330 being round in cross section and sealed where it penetrates each wall to allow for rotation without leakage of air.

A second moving element, a snuffer assembly 350, is provided that moves in a direction shown by Arrow A. Snuffer assembly 350 includes a bottom flat snuffer plate 355, a top snuffer cover 360 and one or more igniters 365. Snuffer assembly 350 starts in an "off" position where it completely covers top opening 317 of snuffing cavity 315, making an air tight seal between bottom surface of flat snuffer plate 355 and a silicone foam seal 318 which surrounds the perimeter of top opening 317 of cavity 315. Snuffer plate 355 may be positioned at an angle of approximately 5 deg to the horizontal, foam seal 318 being positioned at a corresponding angle. As a result, snuffer assembly 350 can move in a horizontal plane (Arrow A) and effectively engage and disengage with foam seal 318 without undue shearing force or distortion.

Figure 3:
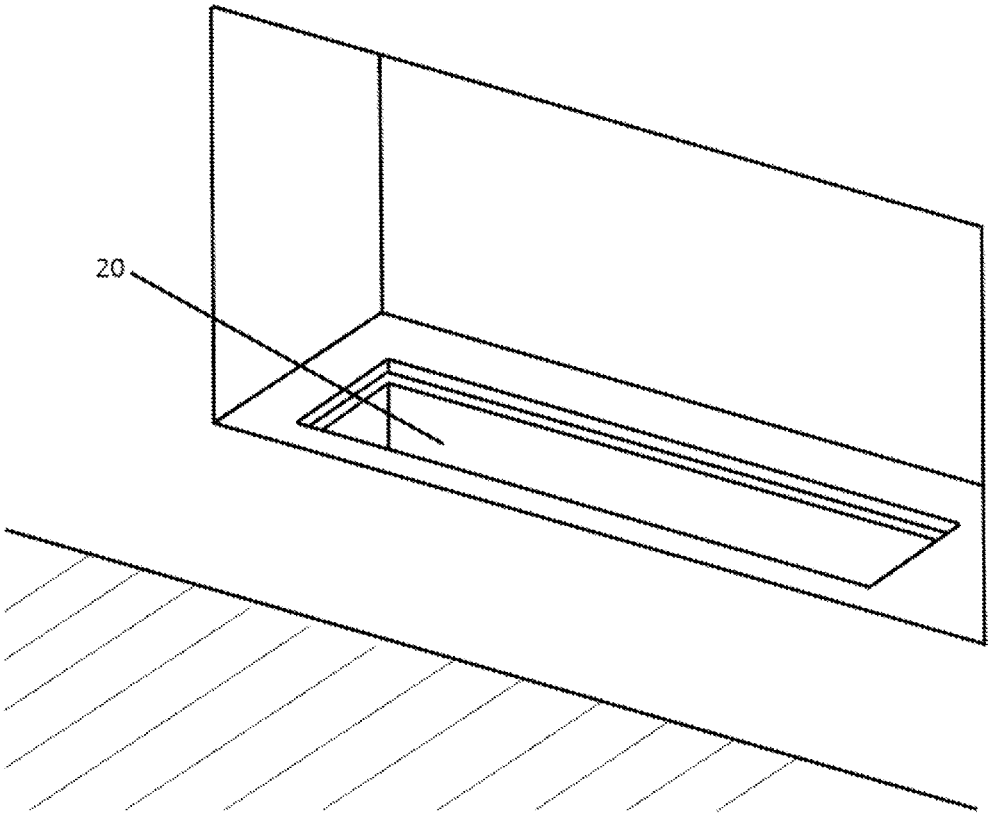
FIG. 3 depicts the fireplace recess of FIG. 2 with a component removed therefrom.

Snuffer assembly 350 also includes an ignition function, provided by the one or more hot surface igniters 365. These igniters may include units operating at 110V AC and ~1A, but may comprise any appropriate hot surface igniters. In accordance with a preferred embodiment of the invention, four igniters may be provided corresponding to two igniters per fuel cell, spaced roughly 6 inches apart, and further preferably one igniter for each burn orifice provided in each fuel cell. A second "ignite" position of snuffer assembly 350 is provided as shown in FIG. 3, wherein the snuffer has moved enough on the direction indicated by Arrow B to partly uncover cavity 315 and fuel cartridges 220, but the portion of snuffer 350 that has the igniters in it is still over the fuel cartridges. Holes are provided in snuffer plate 360 in the vicinity of a heating element of each igniter 365 to allow the heat to project down towards the top surface of each fuel cartridge 220. In order to more fully make use of the heat generated by the surface igniters, each igniter 365 may be provided with a metal reflector positioned above the heating element and preferably elliptically shaped to focus heat down into the fuel cartridge. The heating element is preferably located near the upper foci of the ellipse and the lower foci of the ellipse is contrived to be inside the fuel cartridge, an inch or two down from the top. This helps ensure lighting of both new and partially used fuel cartridges.

Figure 9:
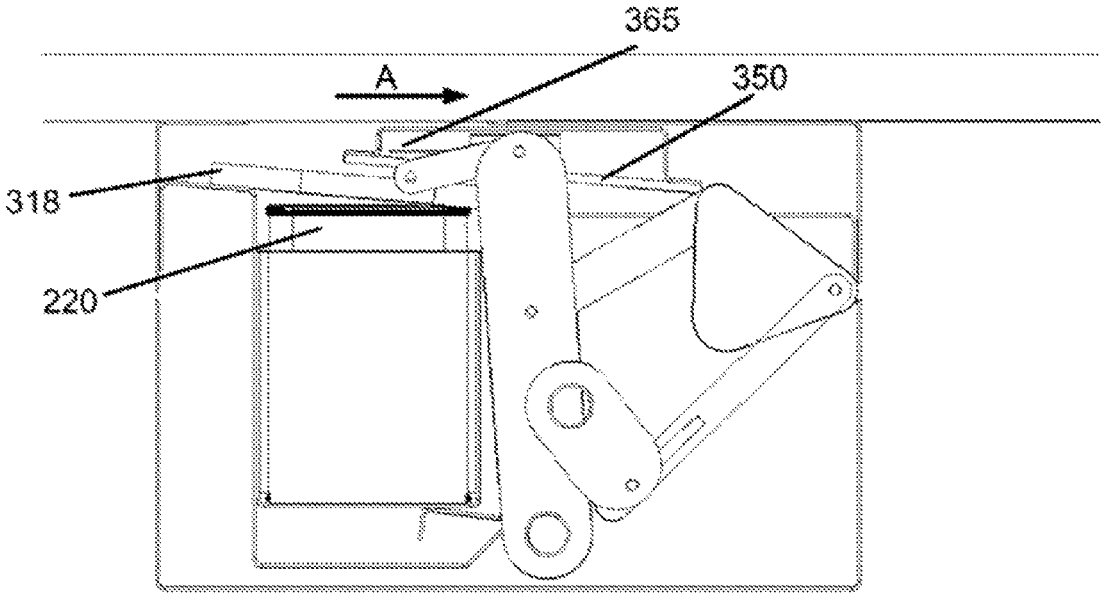
FIG. 9 is a side plan view of the burn module of FIG. 8 moving towards a burn position.
Figure 10:
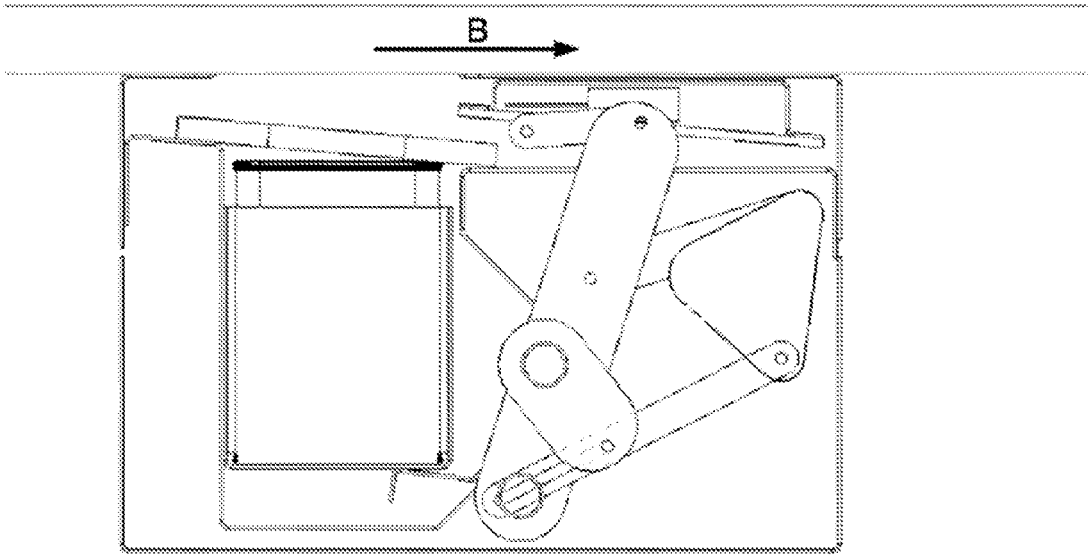
FIG. 10 is a side plan view of the burn module of FIG. 8 in a burn position.

A third "open" position is shown in FIG. 9 and provided for the snuffer assembly in which it has moved horizontally a sufficient distance in the direction of Arrow B to allow elevator 310 to rise out from elevator cavity 315 unimpeded.

Figure 8:
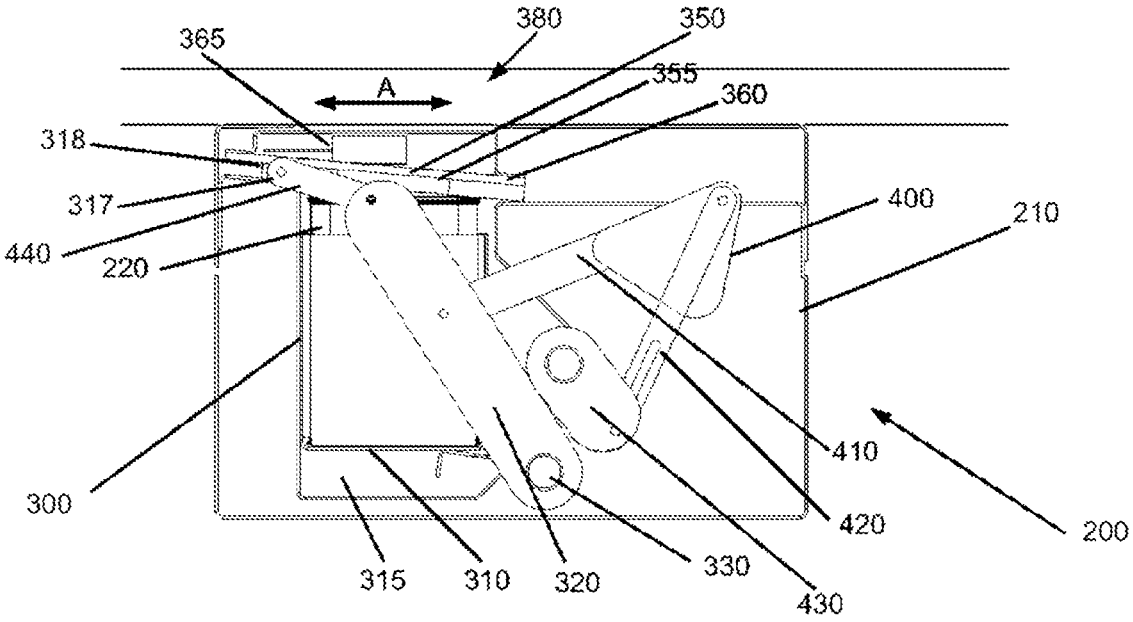
FIG. 8 is a side plan view of a burn module in an off position in accordance with a preferred embodiment of the invention.
Figure 11:
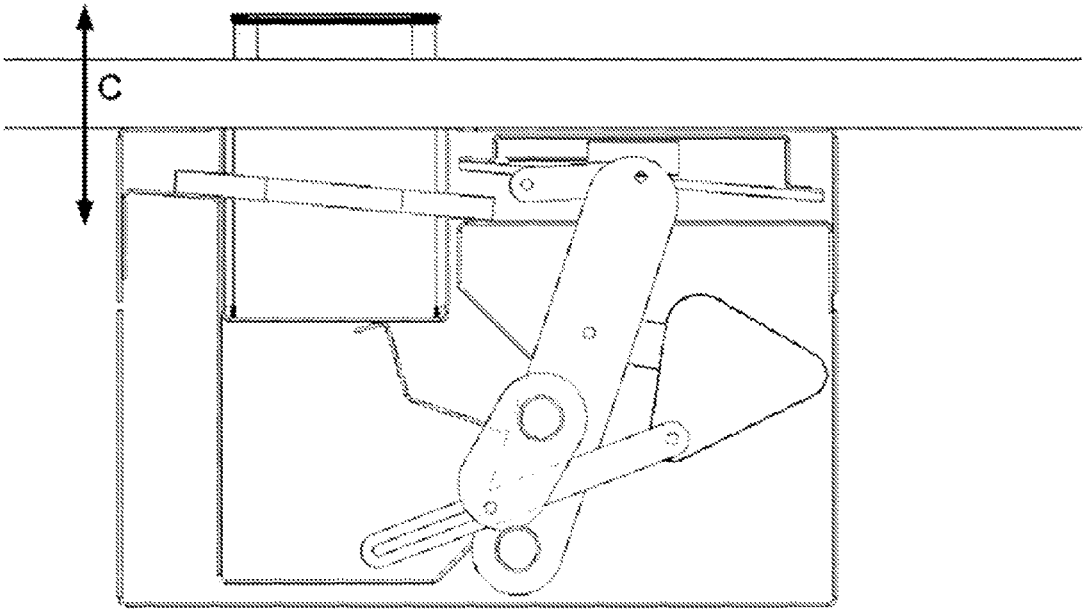
FIG. 11 is a side plan view of the burn module of FIG. 8 in an eject position.

Elevator 310 may preferably be placed into one of three positions differing in a direction indicated by Arrow C, a lower position corresponding to the "off" state of the burn module (as shown in FIG. 8), an intermediate position corresponding to the "on" state of the burn module when a top edge of the one or more fuel cells is positioned above seal 317 and allowing flames to be emitted therefrom, and an uppermost position (as shown in FIG. 11) corresponding to the "eject" state wherein the fuel cartridges 220 project above the top surface of a stone cladding 380 covering burn module 300.

A functional sequence of steps concerning the operation of burn module 330 is as follows:

In an off state (FIG. 8), the elevator is down and the snuffer is closed. If an "on" is requested by the user, the snuffer first moves to the ignite position (FIG. 9) and energizes the igniters for a timed ignition sequence. Then the snuffer is moved to its open state (FIG. 10) at which point the elevator is driven upwards out of the elevator cavity and up to the burn height, where it remains while the fire is burning. If an off command is issued by the user, the movements are reversed exactly, such that the elevator first drops into the elevator cavity, then the snuffer moves over the cavity, sealing the cavity and thereby snuffing out the fire (FIG. 11).

Since the sequence is simple and exactly the same in both directions, in a preferred embodiment, it naturally lends itself to automation with a single driving element. In this preferred embodiment, that element may comprise a crank plate 400 which is rotated through approximately 180 degrees of rotation to bring the system from an off to an eject state. The crank plate rotation is reversed to bring the crank plate 400 back to its original orientation in order to return the system to the off state (FIG. 8). During the rotation of the crank plate, the system passes through each position of the system in sequence: off, ignite, on, eject.

Crank plate 400 may be provided with two drive links (410, 420) connected to it with pin joints. One drive link (420) is used to drive the elevator movement, and the other (410) drives the snuffer movement. The connection points for the two drive links are preferably approximately 90 degrees apart so that they don't interfere with each other. The axis of rotation of the crank plate, and all of the links and other moving parts described, are preferably parallel to the long axis of the burn module. In other words, these axes are both parallel to the floor and to the front face of the fireplace. The crank plate may be located at the right end of the burn module when viewed from the front, and is slightly beyond the width of the elevator cavity. Viewed from the right side of the burn module, the crank plate rotates clockwise to go from an off to an eject state.

The drive link 420 for the elevator connects to a crank lever 430 rigidly attached to pivot shaft of the elevator lifter. The drive link makes this connection using a slotted hole which results in a "lost motion" effect whereby the elevator drive link does not actually drive the elevator at all during the first half of the motion of the crank plate. Once this slot length is taken up, then the drive link pushes the elevator lifter crank lever in such a way as to rotate the elevator lifter clockwise through its full range of travel. The elevator lifter may be provided with a suitable connection to the bottom of the elevator such that it can both lift it and pull it down if necessary, while still having freedom to slide slightly as its end rotates through an arc. A spring may be provided to rotate the lifter lever counter clockwise and thereby pull the elevator lifter back down to the off position. By its elongated nature and the fact that it is pivotably attached at each end, the elevator lifter lever lifts the elevator evenly, without tilting as seen from the front. To prevent tilting as seen from the side, the elevator box may be guided by a combination of the matching shape of the front of the elevator cavity, a light springy force from two opposing pressure fingers mounted at the rear of the elevator cavity, the fact that the ends of the lifter lever are positioned slightly behind the center of gravity of the elevator assembly, and the fact that the movement of the ends of the lifter lever tend to push the elevator assembly towards the front of the elevator cavity when in the upward phase of movement.

The necessity of moving the elongated snuffer assembly forward and back evenly is met with a similar approach. A snuffer lever pivot rod 440 is provided that is mounted low in the base of the burn module. Each end of the pivot rod has a vertically oriented lever arm rigidly mounted to it. The end of each arm is preferably connected to a point near the front of each end of the snuffer assembly by a connecting link which is reasonably horizontal in orientation in the sense that the pivots at the ends of the lever arms are at roughly the same height as the pivots on the snuffer assembly. Once connected in this way, the snuffer assembly remains parallel to the front face of the fireplace. This vertical lever arm is driven by the elevator drive link 410. This link is connected from a pivot on the crank plate to a pivot located roughly in the center of the vertically oriented snuffer lever arm. The snuffer lever arm may further be spring loaded to rotate counter clockwise, which in harmony with the spring on the elevator lifter lever will have the effect of sending the unit into the off state.

In addition to the described mechanical motion, the inventive design may provide a manual shutoff function. This goal is achieved by controlling the connection of crank plate 400 to the drive motor which is used to operate it. A swing gear may be provided which has a few functions. First, it allows the drive motor to be engaged and disengaged from the crank plate. If the motor is not connected to the crank plate, the system will always seek the off state by virtue of an imposed spring bias. The swing gear would similarly be disengaged by default, using another spring. An electromechanical device, such as a solenoid or electromagnet or motor may positively drive the swing gear into engagement as long as power was available to the actuator device. A button may preferably be provided on the door frame of the housing which will disconnect the power to the electromechanical device, thereby allowing the spring to disengage the swing gear which in turn allows the unit to naturally move to the off state. In the event of a power failure the effect would be exactly the same, the loss of power to the electromechanical device would trigger the same sequence of swing gear disengagement and the unit moving to an off state through the action of the springs.

In addition, the swing gear may act as a one-way ratchet, allowing the motor to positively drive the unit from the off state up through the eject state, but not allowing the motor to apply any torque to the crank plate when reversing back to the off state. The system is therefore returned to the off state by the bias force of the springs. As a result, if an object gets caught in the opening of the elevator cavity as the snuffer assembly tries to move across to seal it, the amount of force applied to said object is limited to the spring bias force.

In an additional alternative embodiment of the fireplace system in accordance with the invention, a double-sided double burner system may be provided. This system may be very similar to the burner system described above, but would additionally include a second burn module. Such a double burner system may be employed in either a single or double sided configuration of the fireplace unit as described above.

A "retrofit" variation of the ventless fireplace system constructed in accordance with yet another embodiment of the present invention may also be provided, which would preferably be intended for installation into existing traditional fireplaces, but may be employed in any appropriate configuration. This system is preferably similar to the system described in the preferred embodiment and depicted in FIG. 7, except that the structural insulating box may be reduced to merely a front flange 135 and a bottom section 120. Further, the stonework covering flange 135 and bottom section 120 may be custom-sized to fit the existing fireplace into which the system is being installed.

Therefore, in accordance with various embodiments of the invention, an improved fireplace unit may be provided. Any of the various features of this invention may be combined with any features described above. Any fuel cells describe in accordance with this invention may include those described in U.S. Provisional Patent Application Ser. No. 61/438,551 filed Feb. 1, 2011 to Bebon et al. titled Fuel Cell, and U.S. Provisional Patent Application Ser. No. 61/527,142 filed Aug. 25, 2011 to Bebon et al. titled Fuel Cell, the entire contents of each of these applications being incorporated therein by reference.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that this description is intended to cover all of the generic and specific features of the invention herein described and all statements of the scope of the invention which, as a matter of language, might be said to fall there between.

What is claimed is:

1. A mechanical structure for use with a ventless fireplace, comprising:

a carrier box for accepting one or more fuel cells;

a motor moving the carrier box between two or more positions;

one or more igniters for igniting the one or more fuel cells; and a snuffing plate for snuffing out the flame emanating from the one or more fuel cells;

wherein the carrier box is adapted to be positioned by the motor maintain the one or more fuel cells in a first position when igniting, and a second position when burning; and wherein the carrier box is further adapted to be positioned by the motor to place the one or more fuel cells in a third position when snuffing the one or more fuel cells.

2. The mechanical structure of claim 1, wherein the one or more igniters operate for a predetermined period of time great enough to burn through one or more protective layers of the one or more fuel cells.

3. The mechanical structure of claim 1, wherein the carrier box is adapted to be positioned by the motor to place the one or more fuel cells in a fourth position when ejecting the one or more fuel cells.

4. The mechanical structure of claim 1, wherein the motor drives the carrier box via an elevator lift arm.

5. A ventless fireplace, comprising:

a protective fireplace door, further comprising:

a door frame;

a door bezel hingedly attached to the door frame by one or more hinges;

a door screen fixed within the door bezel; and a latch assembly fixed to the door frame to selectively engage the door bezel from the door frame;

a wall positioned behind the protective fireplace door;

a hearth surface positioned adjacent the wall, the protective fireplace door, wall and hearth surface defining a cavity the hearth surface further defining an opening therein;

a mechanical structure for housing one or more fuel cells positioned below the hearth surface, so that when operational, one or more flames emanating from the one or more fuel cells supported by the mechanical structure pass through the opening in the hearth surface; and one or more igniters for igniting fuel in the one or more fuel cells;

wherein the mechanical structure is adapted to maintain the one or more fuel cells in a first position when igniting, and a second position when burning; and wherein the latch assembly will not disengage the door assembly from the door frame when the one or more fuel cells are in the second position when burning.

6. The ventless fireplace of claim 5, wherein the one or more igniters operate for a predetermined period of time great enough to burn through one or more protective layers of the one or more fuel cells.

7. The ventless fireplace of claim 5, further comprising a manual override of the latch assembly for disengaging the door assembly from the door frame.

8. The ventless fireplace of claim 5, wherein the mechanical structure further comprises a snuffing plate for snuffing out the flame emanating from the one or more fuel cells.

9. The ventless fireplace of claim 8, wherein the mechanical structure is further adapted to place the one or more fuel cells in a third position when snuffing the one or more fuel cells.

10. The ventless fireplace of claim 9, wherein the mechanical structure is further adapted to place the one or more fuel cells in a fourth position when ejecting the one or more fuel cells.

11. The ventless fireplace of claim 10, wherein the fourth position places the one or more fuel cells within the opening defined by the hearth surface.

* * * * *